US006515634B2

(12) United States Patent
Desclos et al.

(10) Patent No.: US 6,515,634 B2
(45) Date of Patent: Feb. 4, 2003

(54) STRUCTURE FOR CONTROLLING THE RADIATION PATTERN OF A LINEAR ANTENNA

(75) Inventors: Laurent Desclos, Tokyo (JP); Eiji Hankui, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/737,778

(22) Filed: Dec. 18, 2000

(65) Prior Publication Data

US 2001/0005181 A1 Jun. 28, 2001

(30) Foreign Application Priority Data

Dec. 22, 1999 (JP) ..... 11-364873

(51) Int. Cl.[7] ..... H01Q 21/00

(52) U.S. Cl. ..... 343/818; 343/815; 343/817; 343/834

(58) Field of Search ..... 343/793, 813, 343/814, 815, 817, 818, 819, 833, 834; H01Q 21/00

(56) References Cited

U.S. PATENT DOCUMENTS 3,935,576 A * 1/1976 Pickles ..... 343/761
4,290,071 A 9/1981 Fenwick
4,591,863 A * 5/1986 Patsiokas ..... 343/702
5,293,172 A 3/1994 Lamberty et al.
5,561,436 A * 10/1996 Phillips ..... 343/702
6,246,374 B1 * 6/2001 Perrotta et al. ..... 343/702
6,278,414 B1 * 8/2001 Filipovic ..... 343/895

FOREIGN PATENT DOCUMENTS

| | | |
|---|---|---|
| EP | 0 812 026 A2 | 12/1997 |
| JP | 08-307142 | 11/1996 |
| JP | 11-136020 | 5/1999 |
| JP | 11-186841 | 7/1999 |

OTHER PUBLICATIONS

Communication from the European Patent Office dated Nov. 27, 2001.

* cited by examiner

*Primary Examiner*—Tho Phan
(74) *Attorney, Agent, or Firm*—Sughrue Mion, PLLC

(57) ABSTRACT

A linear antenna capable of adjusting directivity and impedance matching comprises: a common dipole in which two cylindrical conductors each having a length of λ/4 of the transmission frequency are provided linearly (thus having a total length of λ/2); a plurality of linear parasitic elements that are provided at positions separated by a distance D2 from the axis of the common dipole so as to surround the common dipole; and a U-shaped parasitic element for realizing impedance matching that is arranged in proximity to one end of the common dipole. Each of the linear parasitic elements are arranged parallel to the common dipole and have a length of one half-wavelength of a desired transmission frequency.

13 Claims, 19 Drawing Sheets

STRUCTURE FOR CONTROLLING THE RADIATION PATTERN OF A LINEAR ANTENNA

BACKGROUND OF THE INVENTION

1. Field of the Invention

The present invention relates to an antenna for wireless communication, and particularly to a linear antenna such as a dipole antenna or monopole antenna.

2. Description of the Related Art

Various antennas are in use as antennas for ground wireless communication, one type being the dipole antenna, in which a cylindrical conductor is fed at its center. We refer now to FIG. 1, in which one example of the construction of a dipole antenna is shown. This dipole antenna is provided with two cylindrical conductors 60 in linear form each having a length of ¼ wavelength, these cylindrical conductors 60 being configured so as to be fed by feeding point 61 placed in between them (Fujimoto, K. and James, J. R. Mobile Antenna Systems Handbook. Artech House, Norwood. 1994. pp. 462, 463). In this dipole antenna, a uniform radiation pattern is obtained by supplying a radio-frequency current from feeding point 61.

This type of dipole antenna is often used in, for example, wireless LANs (Local Area Networks), indoor communication systems, portable equipment, and portable telephones (such as a cellular phones), but since this antenna is a construction capable of uniform radiowave radiation to free space (nondirectivity), the presence of scattered objects in the direction of radiation (for example, a human body close to the antenna or obstructions to radiowaves in a wireless LAN environment) affects the radiation characteristics and bring about a reduction in gain and radiation efficiency. As a result, improvements in the radiation characteristics in wireless LANs and indoor communication systems have been sought by using antennas having directivity in a particular direction.

One example of antenna that is directional in any direction is a dipole antenna capable of varying the radiation pattern such as the antenna described in Japanese Patent Laid-open No. 307142/96. FIG. 2(*a*) shows the construction of this antenna, while FIG. 2(*b*) shows its radiation characteristics. As shown in FIG. 2(*a*), this dipole antenna is provided with: half-wave dipole antenna 70 and reflecting element 71 having an arc form and set at a prescribed distance from half-wave antenna 70. In this dipole antenna, electromagnetic waves emitted from half-wave dipole antenna 70 in the direction of point 0 are reflected in the direction of point 0' by reflecting element 71, as shown in FIG. 2(*b*). As a result, the electromagnetic waves that are radiated toward point 0' from half-wave dipole antenna 70 include direct electromagnetic waves that are emitted directly from half-wave dipole antenna 70 and reflected electromagnetic waves that are reflected by reflecting element 71. Although these direct electromagnetic waves and reflected electromagnetic waves combine, their phases diverge because their propagation distances are different, and this antenna therefore exhibits a dual directivity characteristic, as described in the publication.

As described in the foregoing explanation, dipole antennas of the prior art suffered from the problem that, when scattered objects are present in the direction of radiation, the scattered objects bring about a reduction in the radiation characteristic of the antenna.

Since the radiation characteristics of the dipole antenna described in Japanese Patent Laid-open No. 307142/96 can be varied by the reflecting element, the radiation pattern can be set to avoid obstructions and thus mitigate the influence of the above-described obstructions. However, such a dipole antenna is not capable of adequate adjustment of directivity in the horizontal plane and vertical plane, and moreover, its transmission frequency cannot adequately cope with a plurality of frequencies.

Based on the results of experimentation and analysis, the inventors discovered a further improvement in the radiation characteristics of a dipole antenna by addressing the following four points:

When a reflecting element (parasitic element) is provided at a position that is a fixed distance from a dipole antenna, impedance in the dipole antenna as seen from the feeding point varies under the influence of electromagnetic waves generated by the reflecting element. In order to solve this problem, matching is realized between the dipole antenna and a matching circuit that supplies a high-frequency current to the feeding point, thereby obtaining the original antenna characteristics.

When the length of reflecting element (parasitic element) diverges from the length of $\lambda/2$ of the transmission frequency, the reflecting element does not contribute to the adjustment of directivity of the dipole antenna. To solve this problem, the reflecting element is set to the length of $\lambda/2$ of the transmission frequency to allow sufficient adjustment of directivity.

Making the length of the reflecting element (parasitic element) variable allows handling a plurality of transmission frequencies. A dipole antenna that is capable of adjusting directivity and capable of handling a plurality of transmission frequencies has not been previously reported.

Adjustment of directivity is not only made possible in the horizontal plane of the dipole antenna, but in the vertical plane as well. Typically, in a case in which the antenna beam is directed below or above the horizontal plane, the dipole itself must be tilted. A construction in which the dipole is tilted and the beam cast up and down generally can only be realized by mechanical means, and such a structure not only raises the cost of the device, but is disadvantageous for realizing a more compact antenna.

SUMMARY OF THE INVENTION

It is an object of the present invention to provide a linear antenna based on the above-described views that is capable of adjusting directivity and that allows impedance matching.

It is another object of the present invention to provide a linear antenna that can handle a plurality of transmission frequencies.

It is yet another object of the present invention to provide a linear antenna that allows adjustment of both directivity in the horizontal plane and directivity in the vertical plane.

To achieve the above-described objects, the linear antenna of the present invention comprises: a linear radiation element; at least one linear parasitic element having a length of one half-wavelength of a prescribed transmission frequency and arranged parallel to the linear radiation element; and a U-shaped parasitic element arranged in proximity to one end of the linear radiation element.

In the case described above, a construction may be adopted in which a plurality of the linear parasitic elements is arranged in an arc so as to surround the linear radiation element.

In addition, the linear parasitic elements may each be constructed from a plurality of linear conductors that are connected via switch elements, wherein electrical connection can be effected between any adjacent linear conductors. In this case, the linear parasitic element may be constructed such that the length of linear conductors that are connected by all of the switch elements is one half-wavelength of a prescribed transmission frequency. Alternatively, the linear parasitic element may be constructed such that the length of linear conductors that are electrically connected by a portion of the switch elements is one half-wavelength of a prescribed transmission frequency.

In the above-described construction, a plurality of the linear parasitic elements may be arranged in an arc so as to partially surround the linear radiation element. Alternatively, a plurality of the linear parasitic elements may be arranged so as to completely surround the linear radiation element.

In any of the above-described constructions, the linear parasitic elements and the U-shaped parasitic element may each be printed on a plate composed of dielectric material.

Further, the U-shaped parasitic element may have two arms, and may be of a construction in which the arms are arranged parallel to the linear radiation element.

The present invention constructed according to the above description solves the above-described problems by exhibiting the following effects:

In the present invention, the length of linear parasitic elements that are provided around the circumference of a linear radiation element is one half-wavelength of the transmission frequency, and as a result, when a current is induced in the linear parasitic elements by the electromagnetic waves from the linear radiation element, a resonance current flows in the linear parasitic elements. Electromagnetic waves radiated from the linear parasitic elements due to this resonance current combine with electromagnetic waves radiated from the linear radiation element, thereby changing the directivity of the radiation.

In the present invention, moreover, a U-shaped parasitic element is arranged in proximity to one end of the linear radiation element, and this U-shaped parasitic element realizes impedance matching between the linear radiation element and the feed system. Accordingly, there is no divergence in impedance matching between the linear radiation element and feed system as in the prior art.

In cases of the present invention in which a plurality of linear parasitic elements are arranged in an arc around the circumference of the linear radiation element, a radiation pattern having stronger directivity can be realized because the electromagnetic waves radiated from each of the linear parasitic elements that are arranged in an arc combine with electromagnetic waves that are radiated from the linear radiation element.

In cases of the present invention in which the linear parasitic elements are composed of a plurality of linear conductors that are connected via switch elements, the length of the linear parasitic elements can be varied by ON/OFF control of the switch elements, whereby the length of the linear parasitic elements can be set in accordance with a plurality of transmission frequencies.

In cases of the present invention in which a plurality of linear parasitic elements, which are composed of a plurality of linear conductors that are connected via switch elements, are arranged in an arc around the circumference of the linear radiation element, the length of any of the linear parasitic elements can be set to a half-wavelength of the transmission frequency by ON/OFF control of the switch elements. As a result, adjustment of directivity in the horizontal plane can be realized for a particular portion of the bearings of the antenna.

In cases of the present invention in which a plurality of linear parasitic elements, which are composed of a plurality of linear conductors that are connected via switch elements, are arranged around the entire circumference of the linear radiation element, adjustment of directivity in the horizontal plane can be realized for all bearings of the antenna due to the same effect as described above.

In cases of the present invention in which the length of linear conductors that are electrically connected by a portion of the switch elements is the length of one half-wavelength of a desired transmission frequency, the positional relationship of linear conductors that are connected so as to be the length of $\lambda/2$ of the transmission frequency to the linear radiation element can be shifted with respect to the longitudinal direction of the linear radiation element. By controlling this shift, the radiated beam can be directed either below or above the horizontal direction in the vertical plane.

The above and other objects, features, and advantages of the present invention will become apparent from the following description with reference to the accompanying drawings which illustrate examples of the present invention.

DETAILED DESCRIPTION OF THE PREFERRED EMBODIMENTS

Referring now to the accompanying figures, embodiments of the present invention are next described.

First Embodiment

Figure 1:
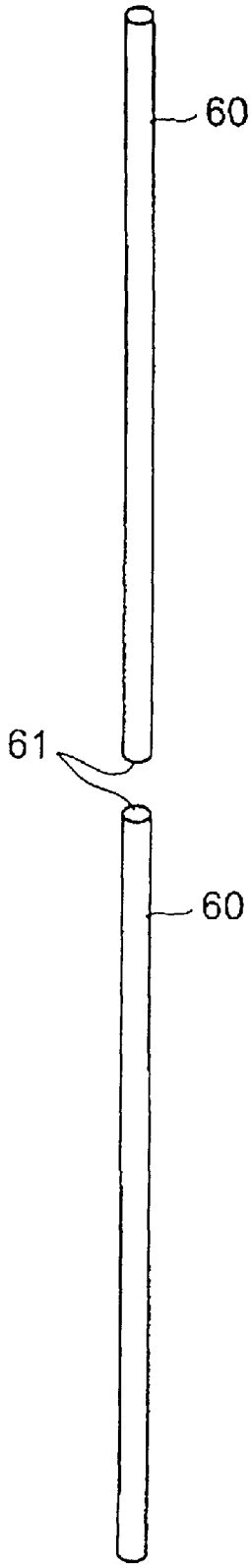
Fig. 1 (Prior Art)
FIG. 1 is a structural diagram showing an example of a dipole antenna of the prior art.
Figure 2A:
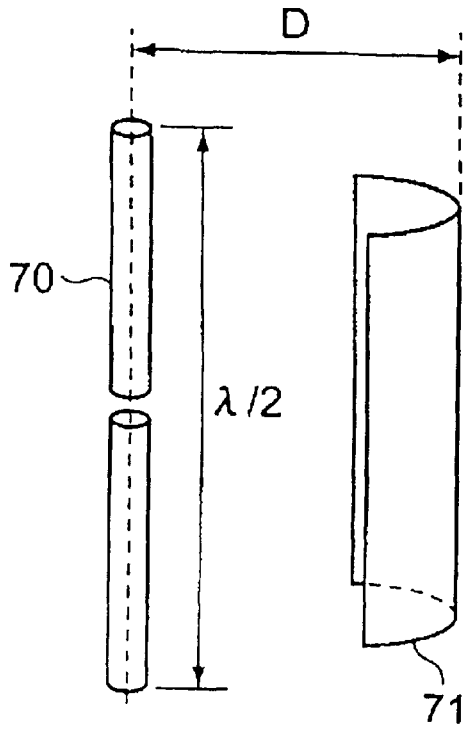
Fig. 2a (Prior Art)
FIG. 2*a* is a structural diagram showing an example of a half-wave dipole antenna with a reflecting element of the prior art.
Figure 2B:
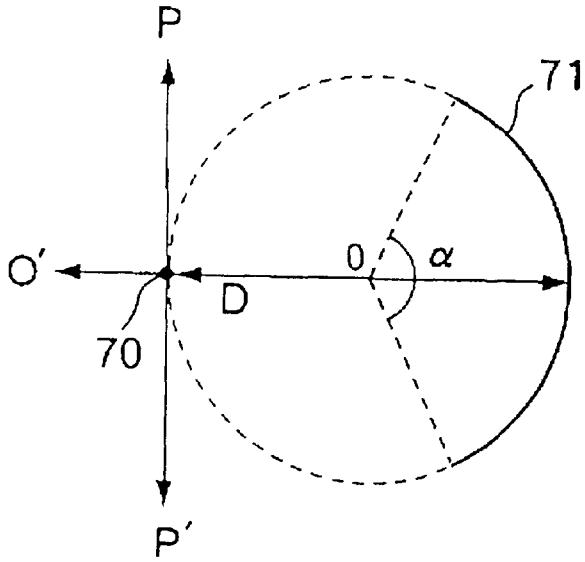
Fig. 2b (Prior Art)
FIG. 2*b* is a schematic view for explaining the radiation characteristics of the half-wave dipole antenna shown in FIG. 2*a*.
Figure 3A:
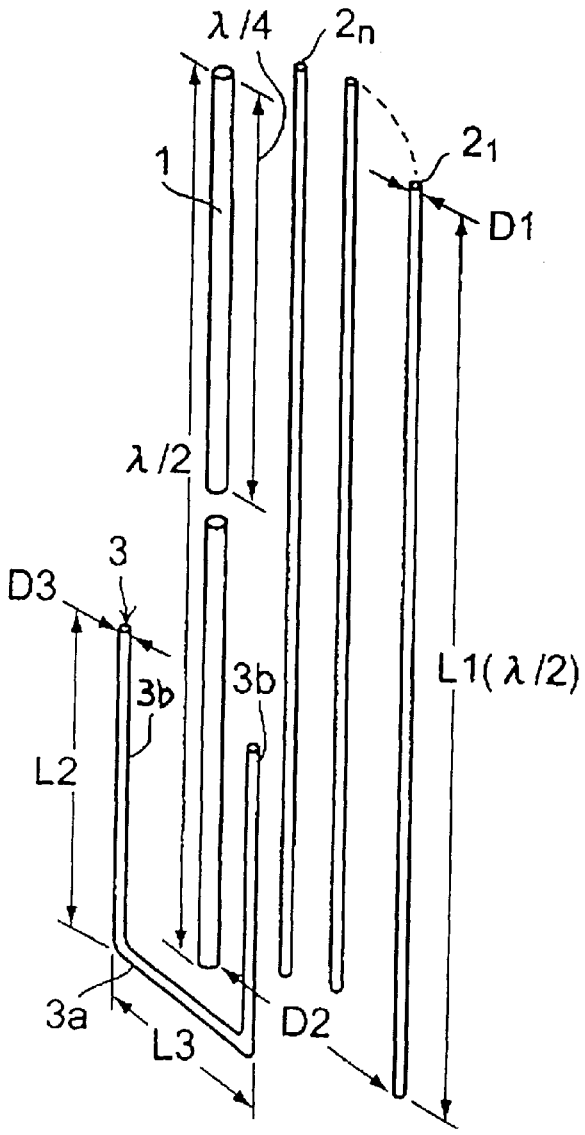
FIG. 3*a* is a perspective view showing the principle elements of a dipole antenna that is the first embodiment of the linear antenna of the present invention.
Figure 3B:
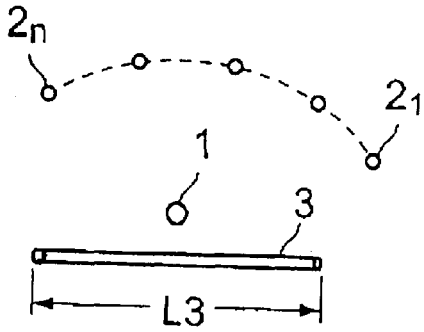
FIG. 3*b* is an upper plan view of the dipole antenna shown in FIG. 3*a*.

FIG. 3*a* shows a perspective view of the main construction of the dipole antenna that is the first embodiment of the present invention, and FIG. 3*b* shows the upper plan view of the antenna. Referring to FIG. 3*a* and FIG. 3*b*, this dipole antenna includes: common dipole 1 in which two cylindrical conductors are provided linearly, each with a length of $\lambda/4$ of the transmission frequency (with a total length of $\lambda/2$ ); a plurality of linear parasitic elements $\mathbf{2}_1$–$\mathbf{2}_n$ provided so as to surround common dipole 1 at positions separated by a distance D2 from the axis of common dipole 1; and U-shaped parasitic element 3 for matching impedance provided in proximity to one end of common dipole 1.

Common dipole 1 includes a feeding point placed in between the two cylindrical conductors, and a radio-frequency current is supplied to this feeding point. Linear parasitic elements $\mathbf{2}_1$–$\mathbf{2}_n$ are cylindrical conductors having a diameter of D1 and a length of L1, and are provided parallel to the axis of common dipole 1. The length L1 of each of the linear parasitic elements $\mathbf{2}_1$–$\mathbf{2}_n$ is the length of $\lambda/2$ of the transmission frequency, and the elements are evenly spaced. U-shaped parasitic element 3 is made up by base portion 3*a* composed of a cylindrical conductor having a diameter of D3 and a length of L3 and two arms 3*b* composed of cylindrical conductors having a diameter of D3 and a length of L2. Each arm 3*b* is parallel to the axis of rotation of common dipole 1.

Figure 4:
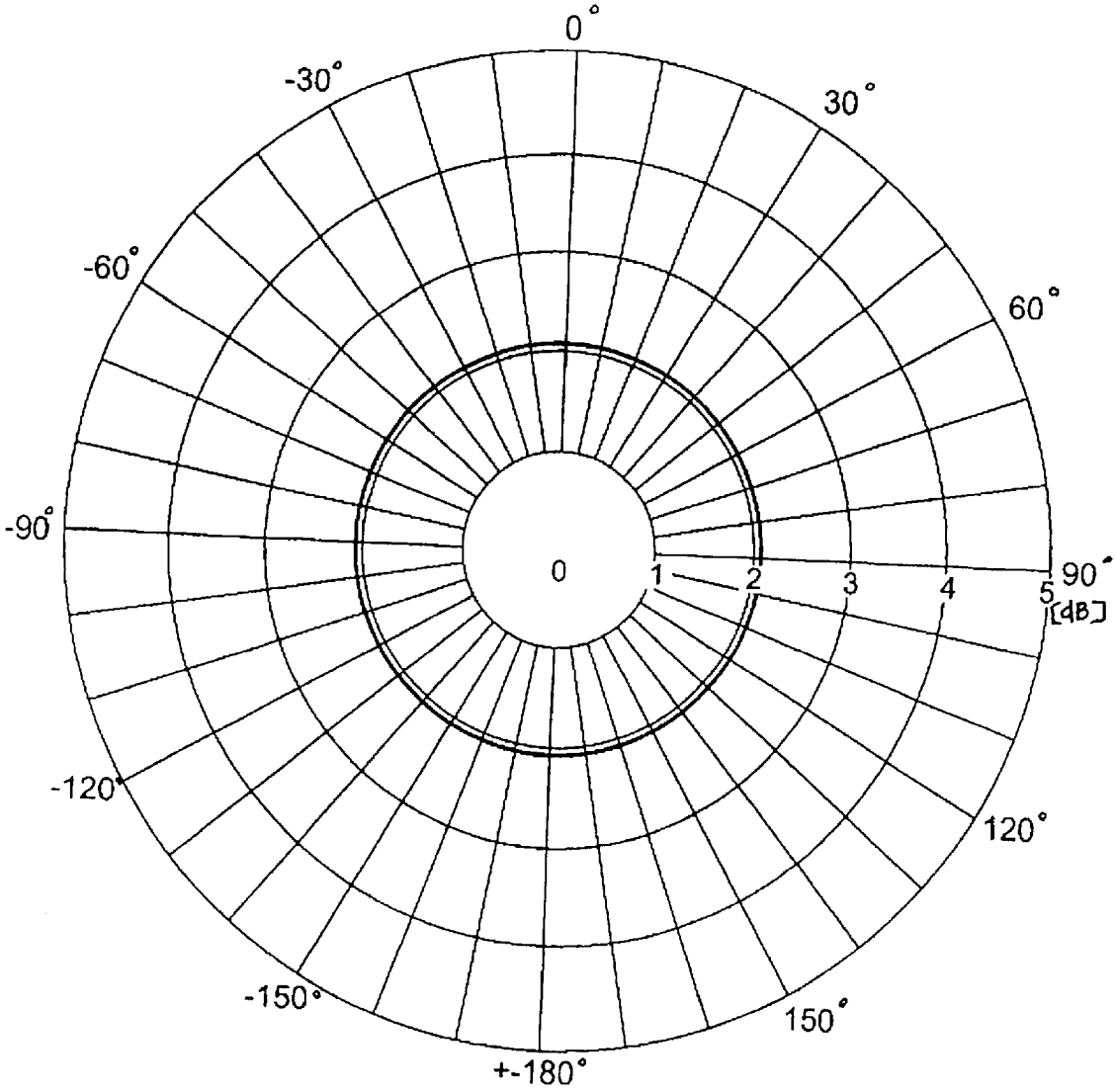
FIG. 4 shows the radiation pattern of the common dipole alone.
Figure 5:
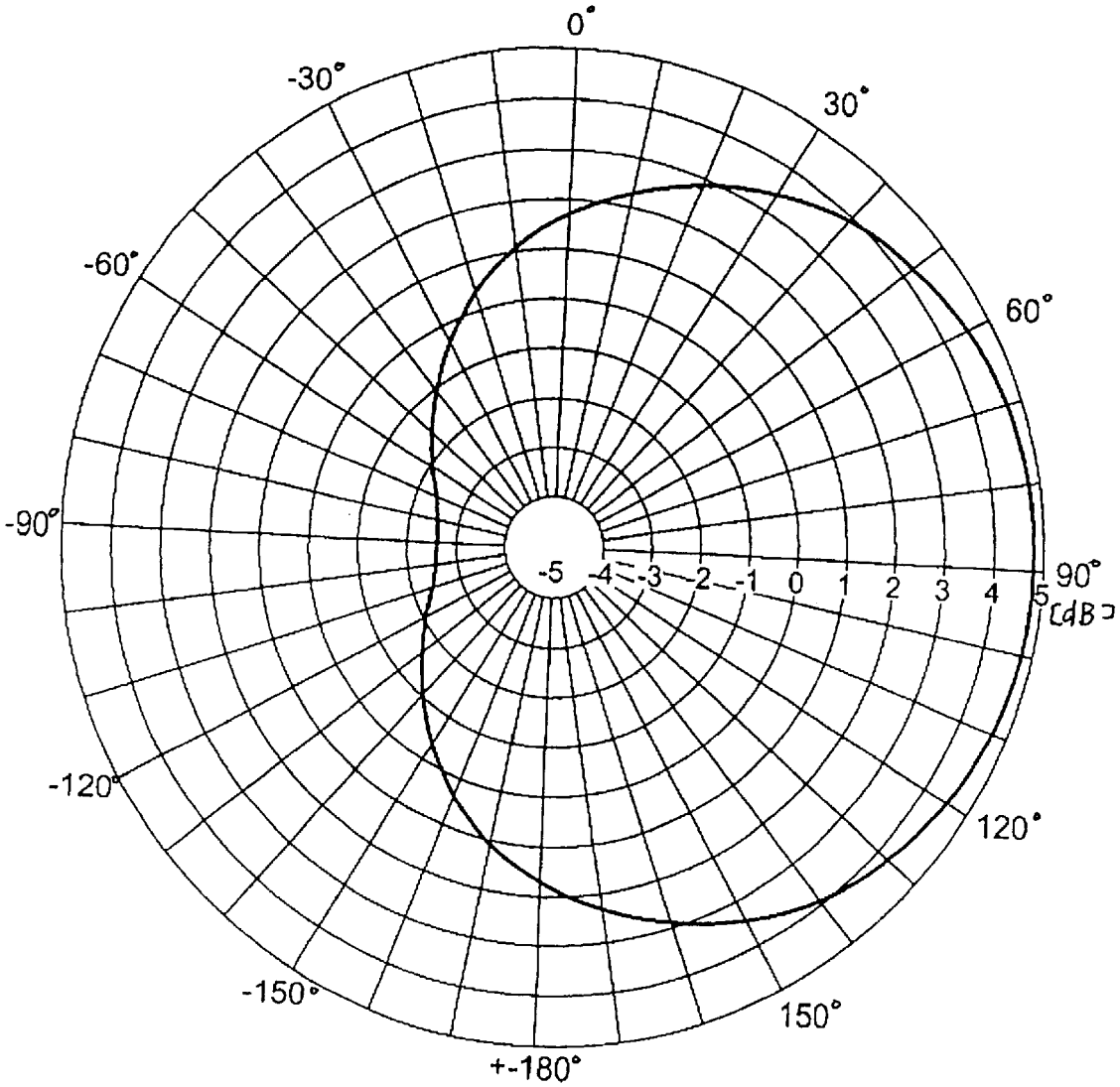
FIG. 5 shows an example of the radiation pattern of the dipole antenna shown in FIG. 3*a*.

In common dipole 1, electromagnetic waves are uniformly emitted in a direction perpendicular to the antenna axis when a high-frequency current is supplied from a feed system not shown in the figures. FIG. 4 shows the radiation pattern at common dipole 1 alone (in the horizontal plane). An electric current is induced in each of linear parasitic elements $\mathbf{2}_1$–$\mathbf{2}_n$ by the electromagnetic waves from the common dipole 1. Since the length of each of linear parasitic element $\mathbf{2}_1$–$\mathbf{2}_n$ is $\lambda/2$ of the transmission frequency, a resonance current is caused to flow in each of linear parasitic elements $\mathbf{2}_1$–$\mathbf{2}_n$. The electromagnetic waves radiated from each of linear parasitic elements $\mathbf{2}_1$–$\mathbf{2}_n$ due to this resonance current combine with the electromagnetic waves radiated from common dipole 1, thereby adjusting the radiation directivity. This directivity adjustment can produce a radiation pattern in which, for example, radiation in one direction (within the horizontal plane) is reduced, as shown in FIG. 5.

Figure 6:
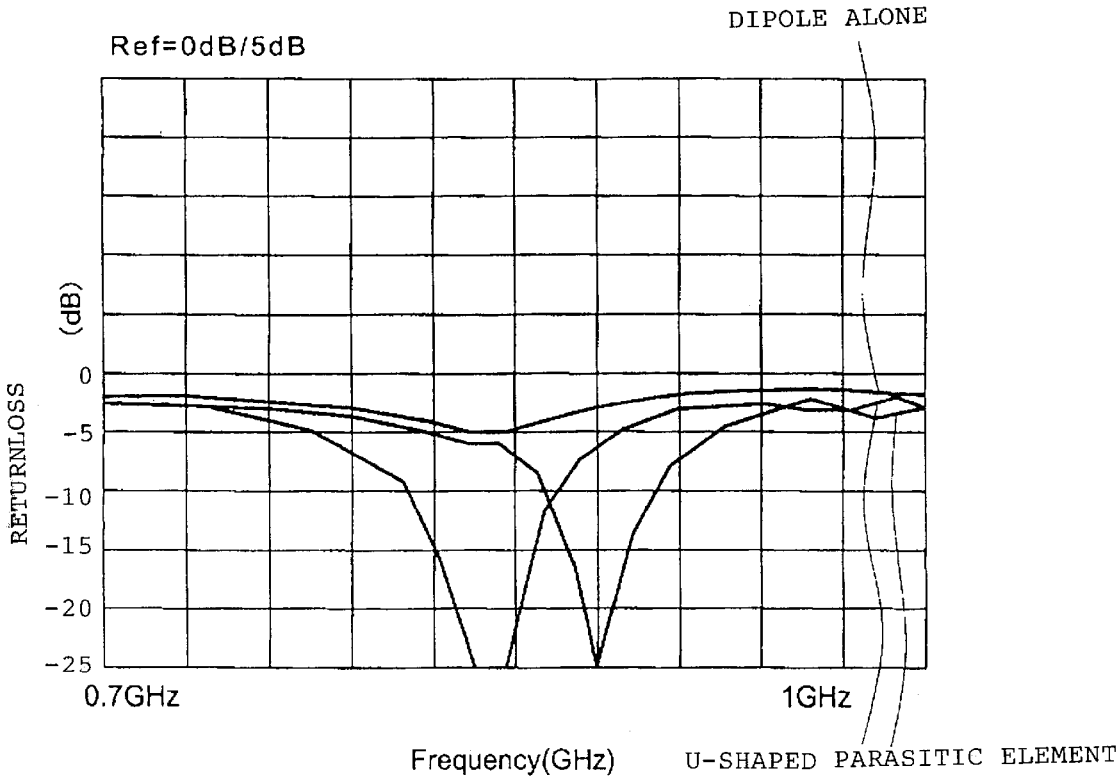
FIG. 6 shows an example of the impedance matching characteristic of a dipole antenna having a U-shaped parasitic element.

Although impedance as seen from the feeding point undergoes change when common dipole 1 receives electromagnetic waves that are radiated from linear parasitic elements $\mathbf{2}_1$–$\mathbf{2}_n$, U-shaped parasitic element 3 in this embodiment enables impedance matching between common dipole 1 and the feed system. FIG. 6 shows the impedance matching characteristic for cases in which the U-shaped parasitic element is included and in which the U-shaped parasitic element is not included. In FIG. 6, the horizontal axis represents the frequency (GHz) and the vertical axis shows the return loss S11 (dB). In this case, the return loss S11 is a ratio of the incident waves and reflected waves of the antenna.

As shown in FIG. 6, the return loss drops precipitously at a particular frequency in a case in which U-shaped parasitic element is provided, indicating that impedance matching is realized at that frequency. When the U-shaped parasitic element is not provided, on the other hand, this sudden drop in return loss does not occur, indicating that the electromagnetic waves radiated from each of the linear parasitic elements are received and the impedance as seen from the feeding point of the common dipole is changed, and impedance matching is no longer realized between the common dipole and the feed system. As can be seen from these circumstances, the provision of U-shaped parasitic element enables impedance matching between common dipole 1 and the feed system.

In FIG. 6, moreover, two examples are shown in which the U-shaped parasitic element is provided, the frequency at which the sharp drop in return loss occurs differing for each. These examples are measurement results obtained when the position of the U-shaped parasitic element is shifted, and it can be seen that the frequency at which impedance matching becomes possible shifts with the position of the U-shaped parasitic element.

The relation between the linear parasitic elements ($\lambda/2$ length) and the directivity of the half-wave dipole antenna is next explained in more concrete terms.

Figure 7A:
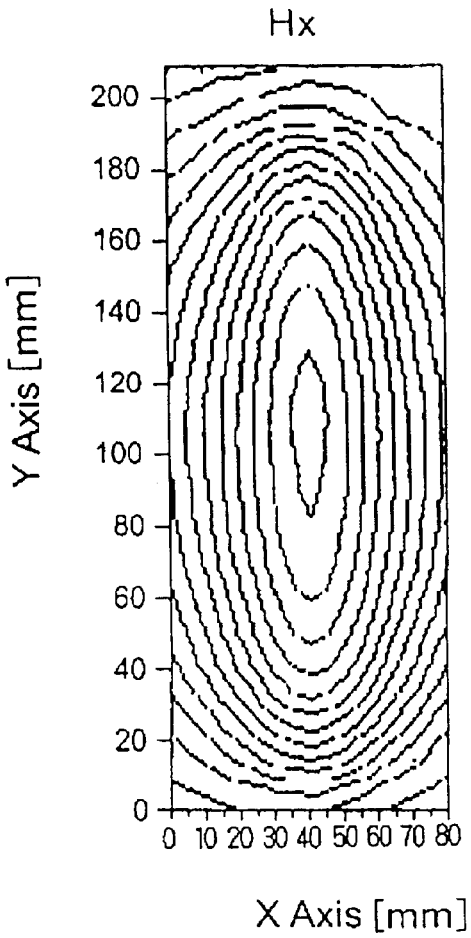
FIG. 7*a* shows the magnetic field component (Hx) in a direction that is perpendicular to the axis of the antenna in the magnetic field distribution of a half-wave dipole antenna alone.
Figure 7B:
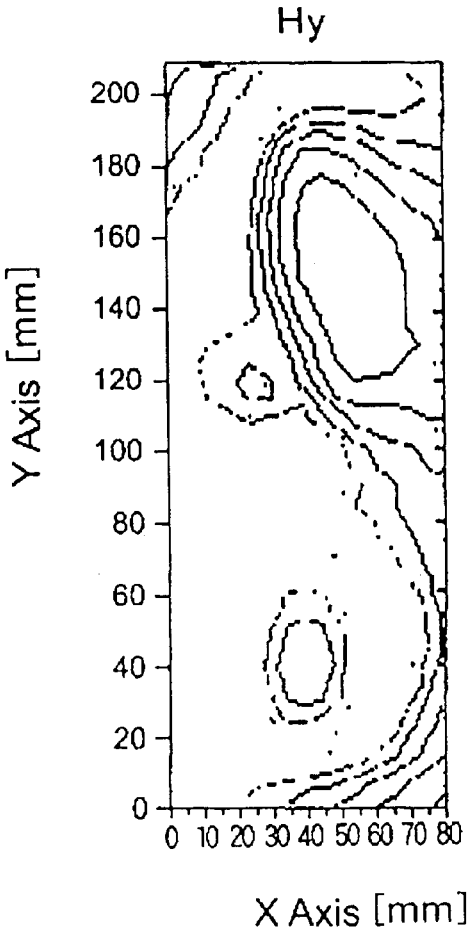
FIG. 7*b* shows the magnetic field component (Hy) in the axial direction of the antenna in the magnetic field distribution of a half-wave dipole antenna alone.

As the magnetic field distribution of half-wave dipole antenna alone, FIG. 7*a* shows the magnetic field component (Hx) in a direction perpendicular to the antenna axis, and FIG. 7*b* shows the magnetic field component (Hy) in the axial direction of the antenna.

Figure 8A:
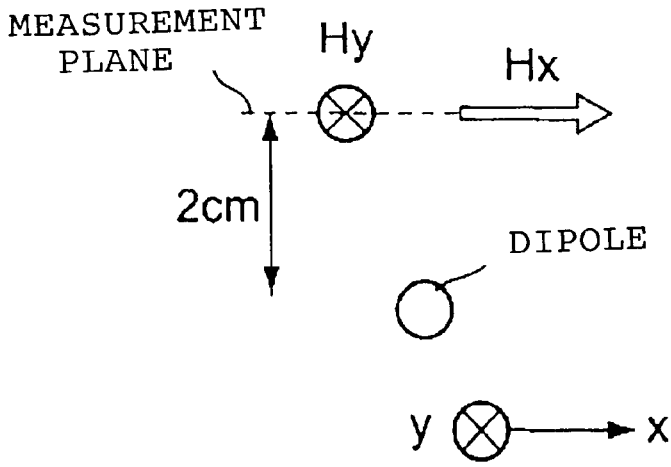
FIG. 8*a* is a schematic view of the antenna arrangement as seen from above when measuring the magnetic field distribution shown in FIG. 7*a* and FIG. 7*b*.
Figure 8B:
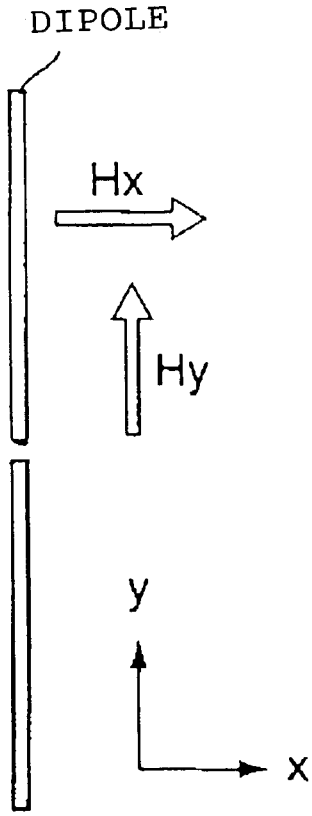
FIG. 8*b* is a schematic view of the antenna arrangement as seen from the side when measuring the magnetic field distribution shown in FIG. 7*a* and FIG. 7*b*.

As shown in FIG. 8*a* and FIG. 8*b*, this magnetic field distribution is measured by scanning a loop sensor for magnetic field reception within a measurement plane that is separated by 2 cm from the axis of the half-wave dipole antenna and measuring each directional component of the magnetic field. Hx and Hy shown in FIGS. 7*a* and 7*b* correspond to Hx and Hy shown in FIGS. 8*a* and 8*b*. In addition, the x-axis and y-axis shown in FIGS. 7*a* and 7*b* each correspond to the directions indicated by arrows x and y shown in FIGS. 8*a* and 8*b*. The relation of the magnitudes of the received magnetic fields is Hx >>Hy, and the change in the pattern can be inferred from the Hx distribution figure. In the case of FIG. 9 and FIG. 13 to be described hereinbelow, the relation is again Hx >>Hy, and in these magnetic field distributions, the position of the feeding point of the half-wave dipole antenna is located in proximity to (x=110 mm, y=40 mm).

Figure 9A:
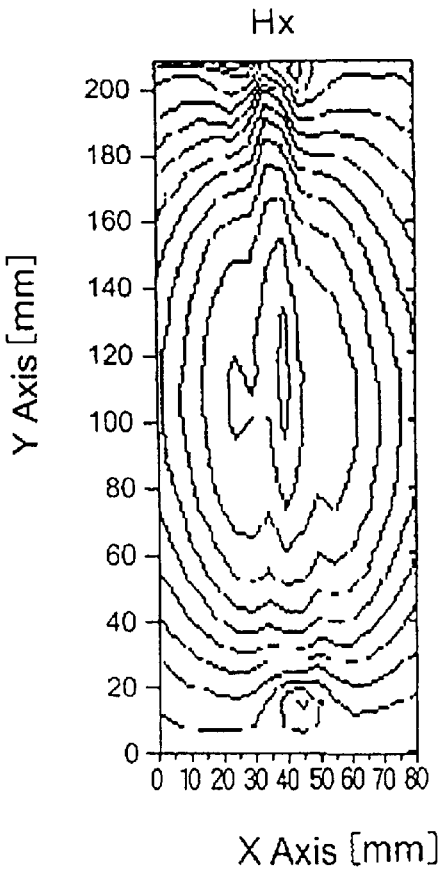
FIG. 9*a* shows the magnetic field component (Hx) in a direction that is perpendicular to the axis of the antenna in the magnetic field distribution of a half-wave dipole antenna having linear parasitic elements ($\lambda/2$ length).
Figure 9B:
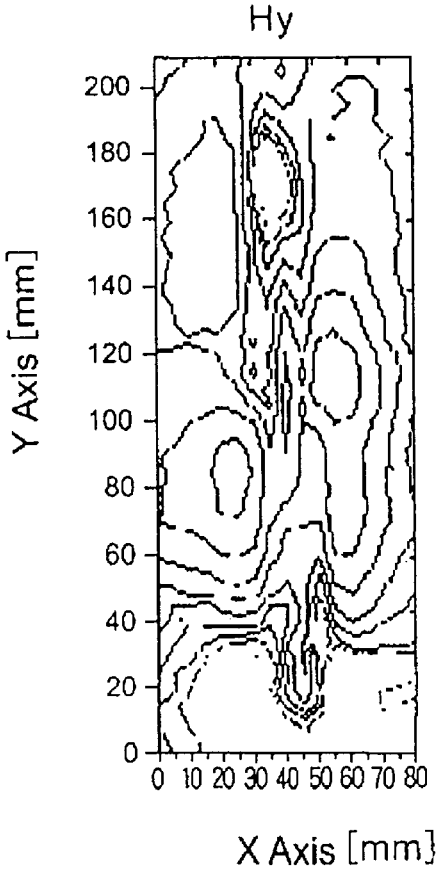
FIG. 9*b* shows the magnetic field component (Hy) in the axial direction of the antenna in the magnetic field distribution of a half-wave dipole antenna having linear parasitic elements ($\lambda/2$ length).
Figure 10:
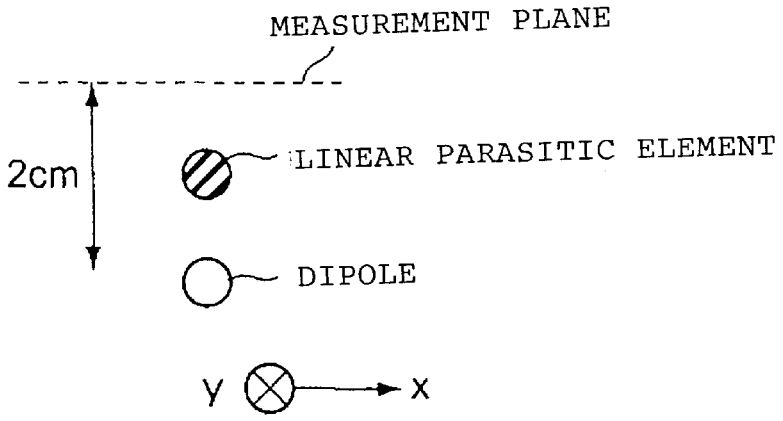
FIG. 10 is a schematic diagram of the antenna arrangement as seen from above when measuring the magnetic field distribution shown in FIG. 9*a* and FIG. 9*b*.

As the magnetic field distribution of a half-wave dipole antenna having linear parasitic elements ($\lambda/2$ length), FIG. 9*a* shows the magnetic field component (Hx) in a direction perpendicular to the antenna axis, and FIG. 9*b* shows the magnetic field component (Hy) in the axial direction of the antenna. As shown in FIG. 10, this magnetic field distribution is measured by scanning a loop sensor for magnetic field reception in a measurement plane that is separated by 2 cm from the antenna axis and measuring each directional component of the magnetic field. In this measurement, the linear parasitic elements are arranged between the measurement plane and the half-wave dipole antenna.

As can be seen by comparing FIG. 7*a* and FIG. 9*a*, the provision of linear parasitic elements results in changes in the magnetic field component in the direction that is perpendicular to the antenna axis. In other words, a half-wave dipole antenna having linear parasitic elements has a radiation pattern with strong directivity in one direction.

Regarding the magnetic field component in the direction of the antenna axis, as shown in FIG. 7*b* and FIG. 9*b*, neither has a magnetic field component and neither influences directivity.

In the above-described construction, the number of linear parasitic elements $\mathbf{2}_1$–$\mathbf{2}_n$ and the size of the arc formed by these elements affect the strength of directivity.

<Working Example>

An actual working example of the dipole antenna according to the above-described first embodiment is next explained.

A dipole having a length of 17 cm is used as common dipole 1; three cylindrical conductors (linear parasitic elements) having a diameter of 2 mm and a length of 18 cm are arranged at a distance of 1 cm from the axis of this dipole; and a U-shaped cylindrical conductor having a diameter of 2 mm, a base portion 2 cm in length, and arm portions 8 cm in length (U-shaped parasitic element) is arranged in proximity to one end of the dipole. The spacing of the three cylindrical conductors (linear parasitic elements) is 1 cm.

A good radiation pattern with strong directivity in one direction was obtained using the dipole antenna of this working example.

[Second Embodiment]

The linear parasitic elements and U-shaped parasitic element that were provided in the dipole antenna of the above-described first embodiment were constituted by cylindrical conductors. In contrast, these components can be replaced by a printed construction.

Figure 11A:
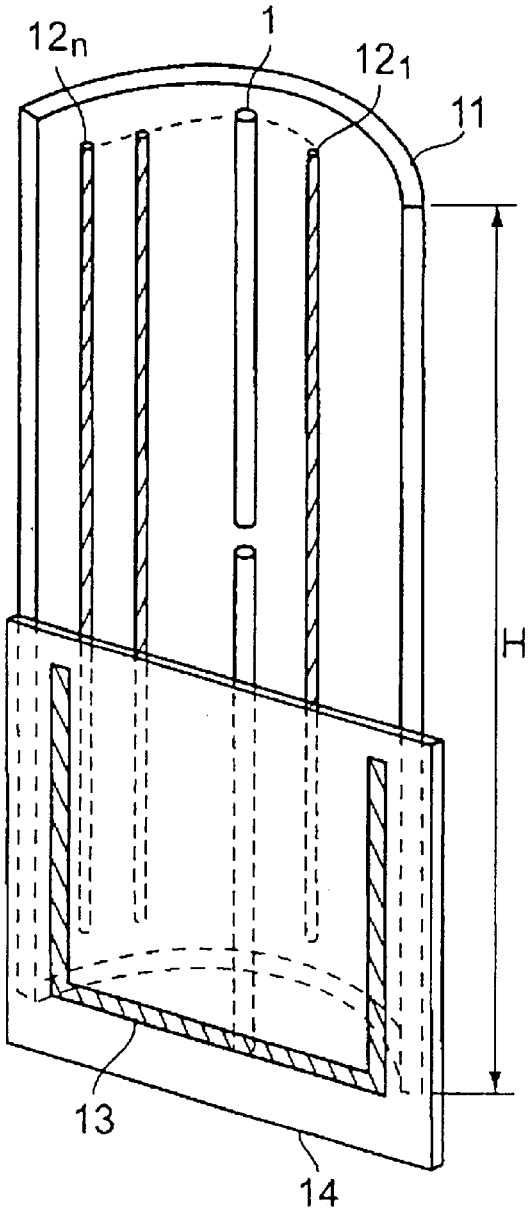
FIG. 11*a* is a perspective view showing the main construction of the dipole antenna that is the second embodiment of the linear antenna of the present invention.
Figure 11B:
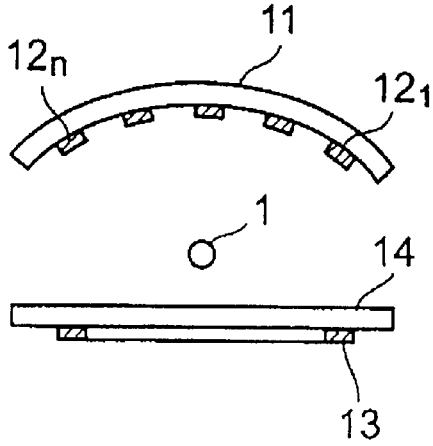
FIG. 11*b* is an upper plan view of the dipole antenna shown in FIG. 11*a*.

FIG. 11*a* is a perspective view showing the main construction of a dipole antenna that is the second embodiment of the linear antenna of the present invention, and FIG. 11*b* is an upper plan view. This dipole antenna is a case in which the linear parasitic elements and U-shaped parasitic element of the dipole antenna shown in FIG. 3*a* and FIG. 3*b* are printed structures. Dielectric 11 in an arc form and on which are printed strip lines $\mathbf{12}_1$–$\mathbf{12}_n$, which are the parasitic elements, is provided at a position separated a prescribed distance from common dipole 1; and dielectric 14 on which is printed U-shaped wiring 13, which is a parasitic element, is provided in proximity to one end of common dipole 1.

Each of strip lines $\mathbf{12}_1$–$\mathbf{12}_n$ is provided parallel to the axis of common dipole 1 on the surface of dielectric 11 that confronts common dipole 1 so as to surround common dipole 1. The length of each of strip lines $\mathbf{12}_1$–$\mathbf{12}_n$ is the length of $\lambda/2$ of the transmission frequency, and the elements are all evenly spaced.

U-shaped wiring 13 is provided on the surface of dielectric 14 that confronts common dipole 1, and as with the above-described U-shaped parasitic element, comprises a base portion and two arms, each arm being configured parallel to the axis of common dipole 1.

As in the above-described first embodiment, electromagnetic waves from common dipole 1 in the dipole antenna of this embodiment induce a current and cause a resonance current to flow in each strip lines $\mathbf{12}_1$–$\mathbf{12}_n$. Electromagnetic waves radiated from each of strip lines $\mathbf{12}_1$–$\mathbf{12}_n$ due to this resonance current combine with electromagnetic waves radiated from common dipole 1, thereby realizing adjustment of the radiation directivity.

In addition, the provision of U-shaped wiring 13 allows impedance matching to be realized between common dipole 1 and the feed system.

The above-described strip lines $\mathbf{12}_1$–$\mathbf{12}_n$ and U-shaped wiring 13 are not limited to a printed form, and may be formed by other known wiring formation methods.

[Third Embodiment]

Although adjustment of the directivity of common dipole 1 can be realized by providing linear parasitic elements around the circumference of common dipole 1 as described in each of the above-described embodiments, the length of the linear parasitic elements in such a case must be $\lambda/2$ of the transmission frequency. In other words, if linear parasitic elements of a length other than $\lambda/2$ of the transmission frequency are provided around the circumference of common dipole 1, the linear parasitic elements will not exert an effect on the radiation pattern of common dipole 1. In adjusting the directivity by linear parasitic elements, moreover, the number of linear parasitic elements and the size of the arc formed by these elements have a great influence on the strength of directivity. For example, the directivity becomes acute if a large number of linear parasitic elements are provided and a large arc is formed, and conversely, the directivity becomes less pronounced if few linear parasitic elements are provided and a small arc is formed.

A desired radiation pattern can be obtained by taking advantage of these factors. In addition, the radiation pattern can be cast toward a particular bearing of the antenna by controlling the positional relation of the arc that is formed by the linear parasitic elements and common dipole 1.

Figure 12A:
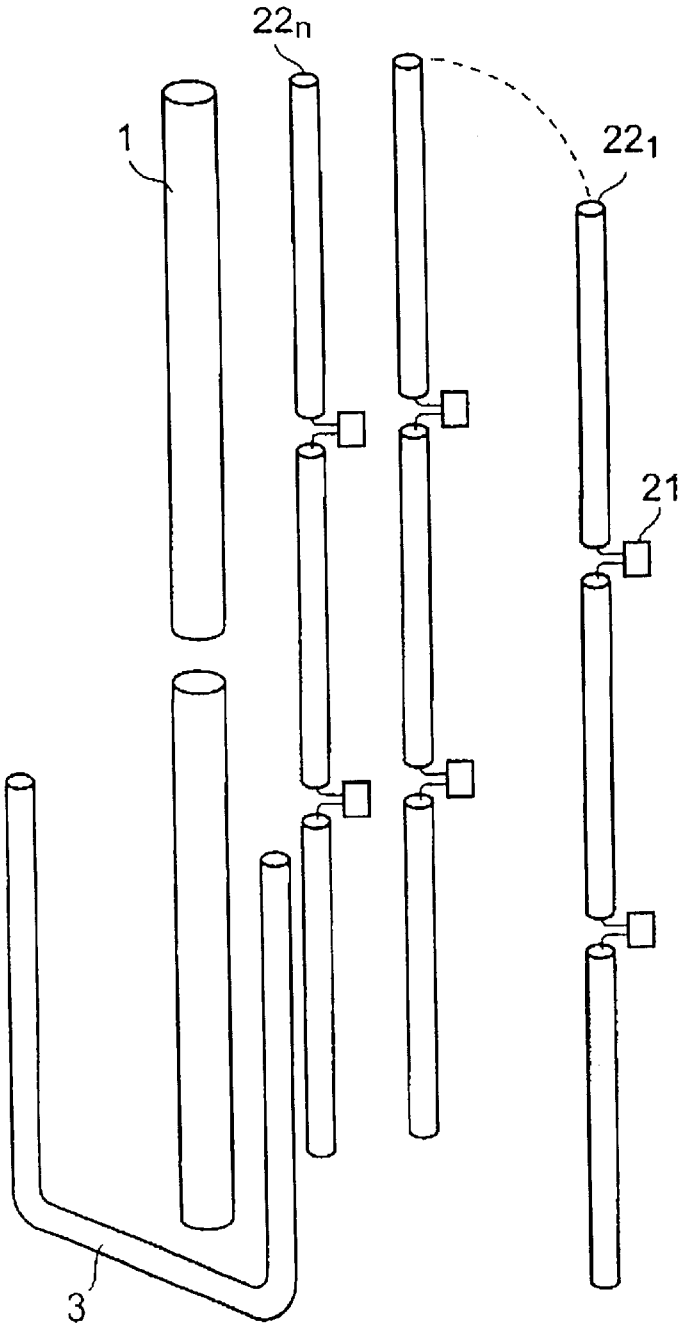
FIG. 12*a* is a perspective view showing the main construction of the dipole antenna that is the third embodiment of the linear antenna of the present invention.
Figure 12B:
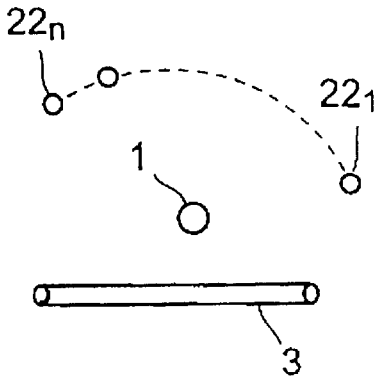
FIG. 12*b* is an upper plan view of the dipole antenna shown in FIG. 12*a*.

FIG. 12*a* is a perspective view showing the main construction of a dipole antenna that is the third embodiment of the linear antenna of the present invention, and FIG. 12*b* is an upper plane view. This dipole antenna is a construction that enables variation of the length of the linear parasitic elements of the construction shown in FIG. 3*a* and FIG. 3*b*, and apart from the provision of linear parasitic elements $\mathbf{22}_1$–$\mathbf{22}_n$ at positions separated by a prescribed distance from common dipole 1, has the same construction as the above-described first embodiment.

Each of linear parasitic elements $\mathbf{22}_1$–$\mathbf{22}_n$ has the same construction, each allowing variation of the length of the element. Taking linear parasitic element $\mathbf{22}_1$ as an example for explaining the construction of the elements, linear parasitic element $\mathbf{22}_1$ comprises three cylindrical conductors of prescribed length, each of the cylindrical conductors being electrically connectable via switches 21. This element is constructed such that when all three cylindrical conductors are connected, the combined length is the length of $\lambda/2$ of the transmission frequency. Each of switches 21 is connected via an external port that is not shown in the figure to a control circuit not shown in the figure, and the length of the element can thus be varied by ON/OFF control by this control circuit.

Regarding variation of the element length, cylindrical conductors that are electrically connected via switches 21 are electrically isolated by turning OFF switches 21. Various switches can be used as switches 21, including for example, semiconductor switches such as FET and MOS. In a case in which FET are used, the resistance of the switches is 1 ohm when ON and 4 k ohm when OFF.

In this dipole antenna, the length of desired elements among linear parasitic elements $\mathbf{22}_1$–$\mathbf{22}_n$ can be made the length of $\lambda/2$ of the transmission frequency by turning ON switches 21 for these linear parasitic elements, and the element length for the other linear parasitic elements can be made a length different from $\lambda/2$ of the transmission frequency by turning OFF switches 21. In this way, the number of linear parasitic elements that contribute to adjustment of directivity of common dipole 1 can be freely set, and the size of the arc and the positional relation of the arc and common dipole 1 can also be freely set.

The influence exerted by the linear parasitic elements upon the radiation characteristics of the common dipole is next described in concrete terms.

Figure 13A:
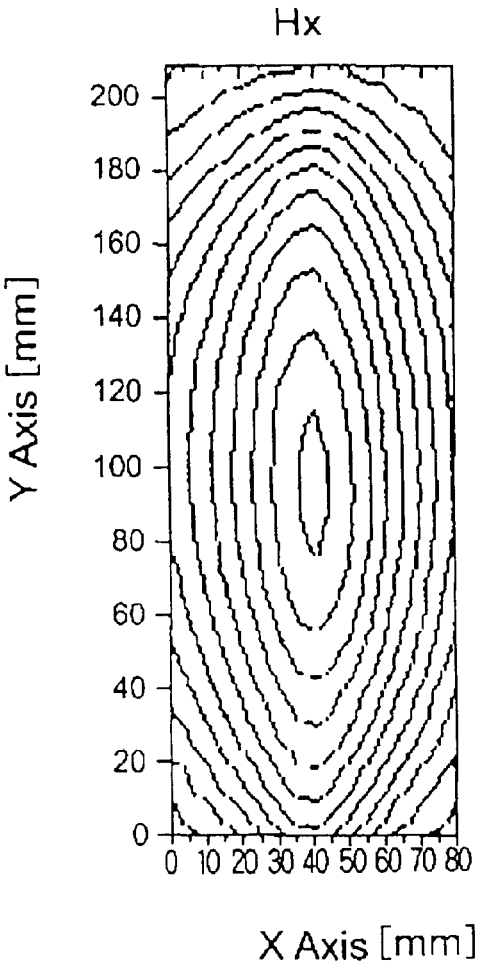
FIG. 13*a* shows the magnetic field component (Hx) in a direction that is perpendicular to the antenna axis in the magnetic field distribution when switches of the antenna shown in FIG. 12*a* and FIG. 12*b* are in the OFF state.
Figure 13B:
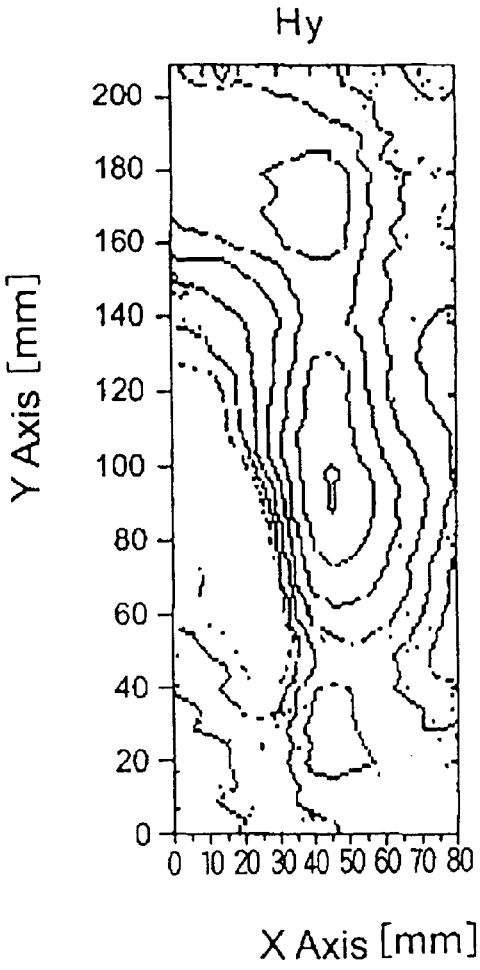
FIG. 13*b* shows the magnetic field component (Hy) in the axial direction of the antenna in the magnetic field distribution when switches of the antenna shown in FIG. 12*a* and FIG. 12*b* are in the OFF state.
Figure 14A:
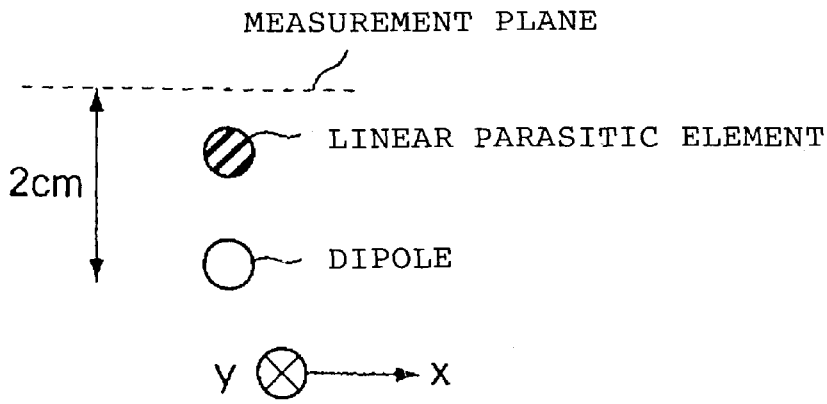
FIG. 14*a* is a schematic view of the antenna arrangement as seen from above when measuring the magnetic field distribution shown in FIG. 13*a* and FIG. 13*b*.
Figure 14B:
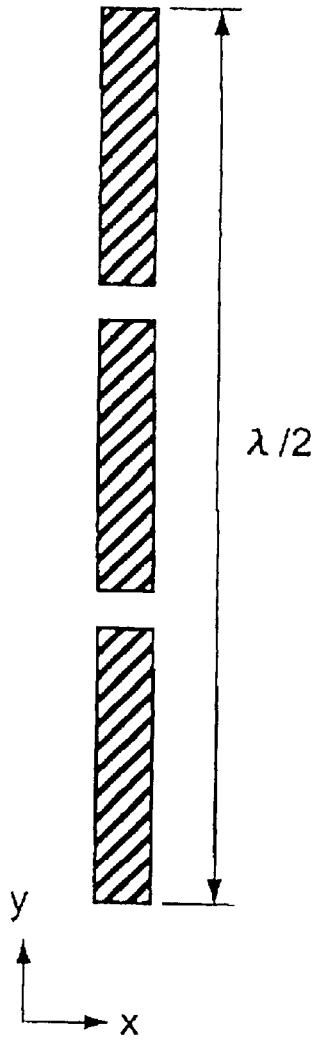
FIG. 14*b* is a schematic view of the antenna arrangement as seen from the side when measuring the magnetic field distribution shown in FIG. 13*a* and FIG. 13*b*.

FIG. 13*a* shows the magnetic field component (Hx) in a direction that is perpendicular to the antenna axis when the switches are in the OFF state, and FIG. 13*b* shows the magnetic field component (Hy) in the direction of the antenna axis when the switches are in the OFF state. The measurement of this magnetic field distribution is realized by scanning loop sensor for magnetic field reception within a measurement plane that is separated by 2 cm from the antenna axis of the common dipole as shown in FIG. 14*a* and measuring each directional component of the magnetic field. When the switches are in the OFF state, the three cylindrical conductors that constitute each of the linear parasitic elements are each electrically isolated as shown in FIG. 14*b*, and the length of each diverges widely from the length of $\lambda/2$ of transmission frequency. The cylindrical conductors therefore do not influence the radiation pattern of the common dipole.

Figure 15:
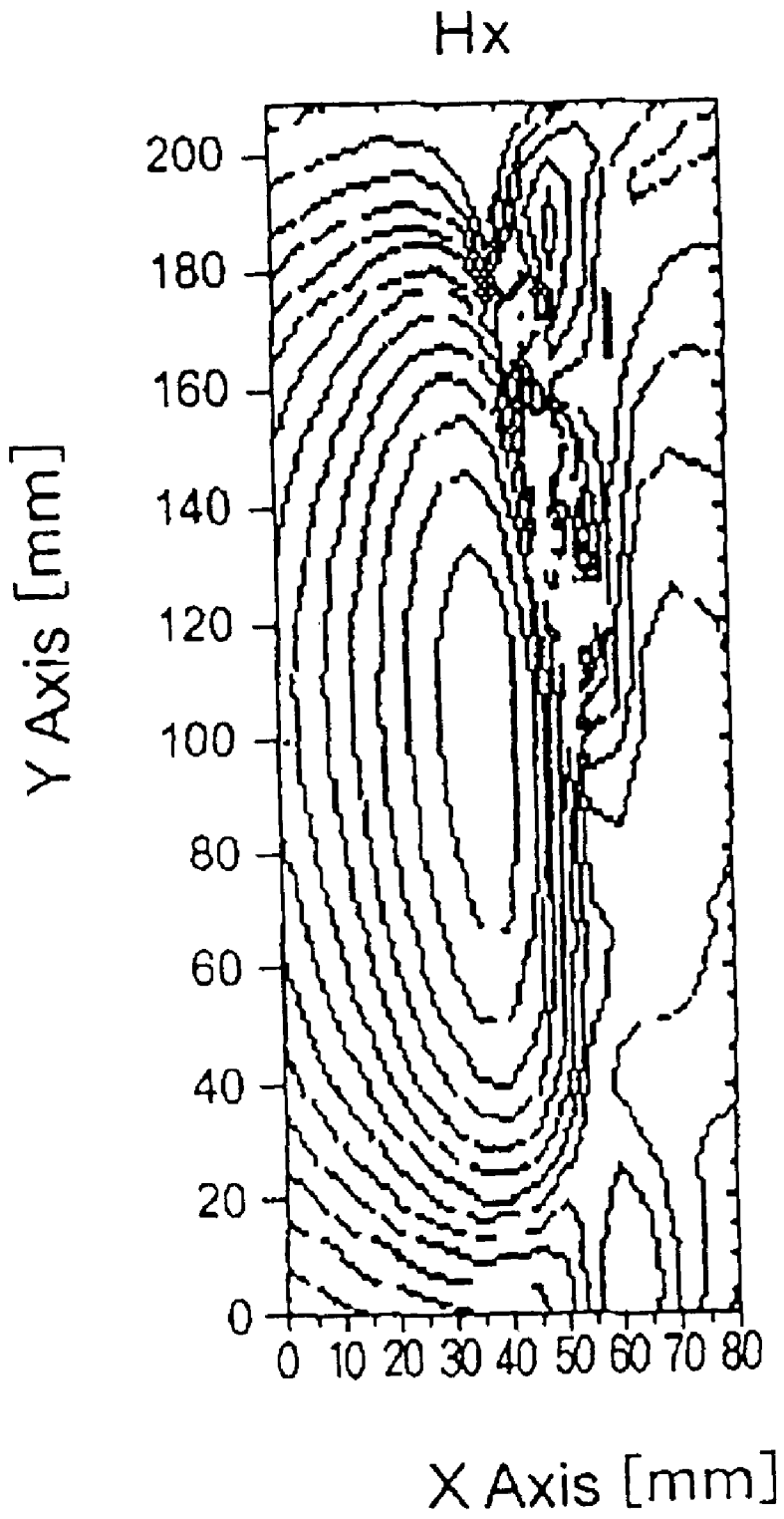
FIG. 15 shows the magnetic field component (Hx) in a direction that is perpendicular to the antenna axis in the magnetic field distribution when switches of the antenna shown in FIG. 12*a* and FIG. 12*b* are in the ON state.
Figure 16A:
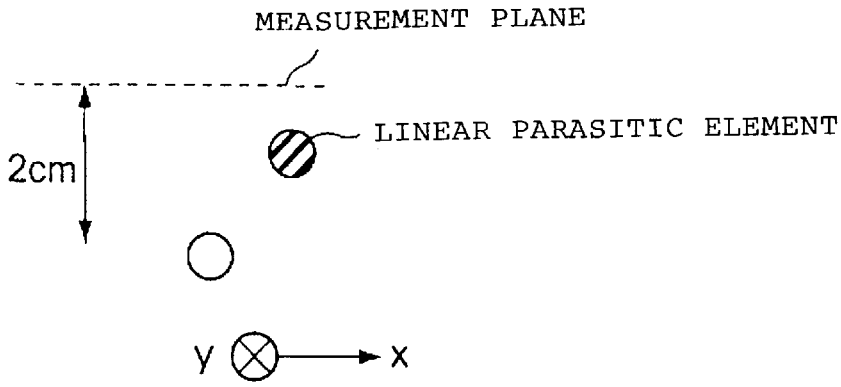
FIG. 16*a* is a schematic view of the antenna arrangement as seen from above when measuring the magnetic field distribution shown in FIG. 15.
Figure 16B:
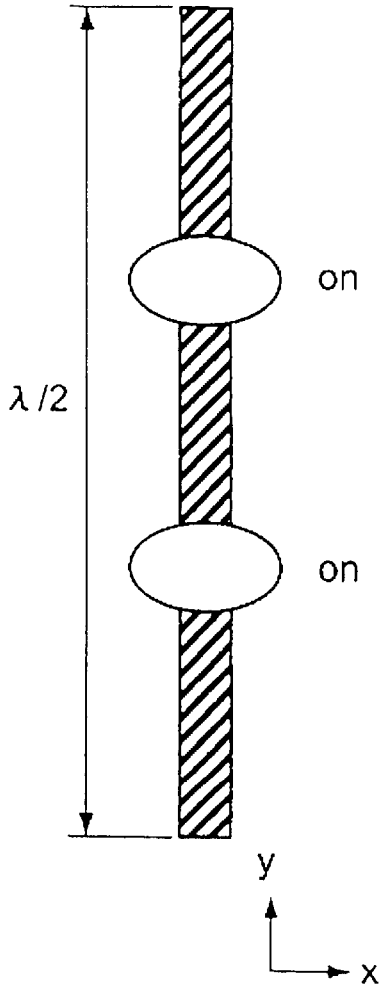
FIG. 16*b* is a schematic diagram of the antenna arrangement as seen from the side when measuring the magnetic field distribution shown in FIG. 15.

FIG. 15 shows magnetic field component (Hx) in a direction that is perpendicular to the antenna axis when the switches are in the ON state. The measurement of this magnetic field distribution is obtained by scanning a loop sensor for magnetic field reception within a measurement plane that is separated by 2 cm from the antenna axis of the common dipole, as shown in FIG. 16*a*, and measuring each directional component of the magnetic field. When the switches are in the ON state, the three cylindrical conductors that make up each linear parasitic element are electrically connected as shown in FIG. 16*b*, and the length in the connected state is $\lambda/2$ of the transmission frequency. As a result, the linear parasitic elements have a strong influence on the radiation characteristics of the common dipole, and a radiation pattern is obtained in which radiation in one direction is reduced.

As described in the foregoing explanation, any radiation pattern can be obtained through ON/OFF control of switches 21, and furthermore, these radiation pattern can be cast toward certain bearings of the antenna.

[Fourth Embodiment]

In the above-described third embodiment, linear parasitic elements were arranged in an arc around the circumference of a common dipole, but an arrangement of these linear parasitic elements around the entire circumference of the common dipole would allow the radiation pattern to be cast in all bearings of the antenna.

Figure 17A:
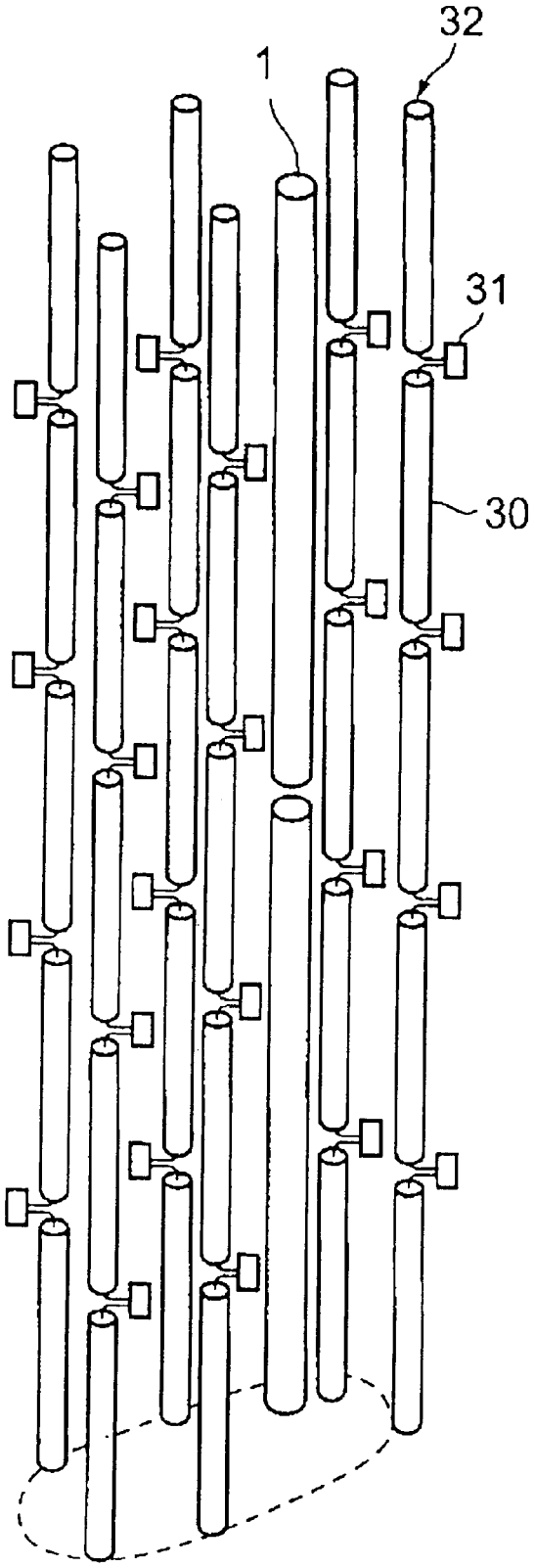
FIG. 17*a* is a perspective view showing the main construction of a dipole antenna that is the fourth embodiment of the linear antenna of the present invention.
Figure 17B:
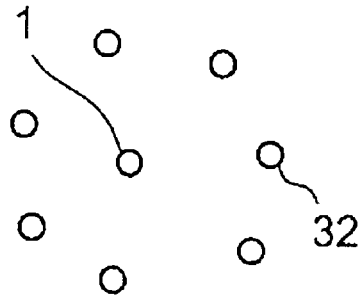
FIG. 17*b* is an upper plan view of the dipole antenna shown in FIG. 17*a*.

FIG. 17*a* is a perspective view showing the principle construction of a dipole antenna that is the fourth embodiment of the linear antenna of the present invention, and FIG. 17*b* shows the upper plan view. This dipole antenna has the same construction as the antenna of the above-described third embodiment with the exception that a plurality of linear parasitic elements 32, each of which is constructed from five cylindrical conductors of prescribed length that can be electrically connected by switches 31, are provided around the entire circumference of common dipole 1. For the sake of convenience, the U-shaped parasitic element has been omitted from FIG. 17*a* and FIG. 17*b*.

Each of linear parasitic elements 32 is configured so as to have a length of $\lambda/2$ of the transmission frequency when the five cylindrical conductors 30 are all connected.

In this dipole antenna, the lengths of desired linear parasitic elements among linear parasitic elements 32 can be made the length of $\lambda/2$ of the transmission frequency by turning ON switches 31 for these elements, and the lengths of each of the other linear parasitic elements 32 can be made a length that differs from the length $\lambda/2$ of the transmission frequency by turning OFF switches 31 for these elements. Thus, the number of linear parasitic elements that contribute to the adjustment of directivity of common dipole 1 can be freely set, and the size of the arc as well as the positional relation between the arc and common dipole 1 can also be freely set.

In this embodiment, therefore, the setting of linear parasitic elements 32 that contribute to the adjustment of directivity of common dipole 1 can be made freely around the entire circumference of common dipole 1, and the radiation pattern can therefore be controlled for all bearings of the antenna.

Figure 18:
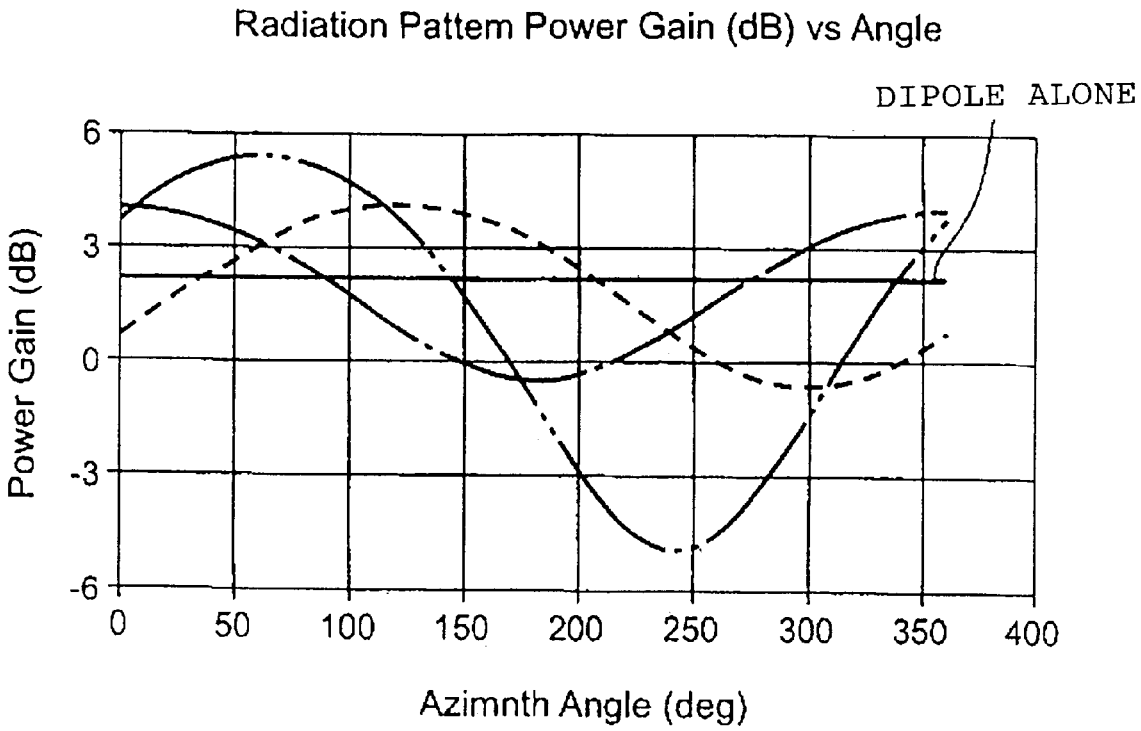
FIG. 18 shows the relation between the azimuth angle of the antenna and the radiation power.

FIG. 18 shows the relation between the azimuth angle of the antenna and radiation power. In FIG. 18, the solid line indicates a case of the dipole alone, the single dot and dash line indicates a case in which only a few linear parasitic elements contribute to adjustment of directivity and the arc is small, the broken line indicates a case in which a greater number of linear parasitic elements contribute to adjustment of directivity and the arc is made larger, and the double dot and dash line indicates a case in which the a still greater number of linear parasitic elements contribute to adjustment of directivity and the arc is made still larger. Since the radiation power is great in the vicinity of azimuth angle 50° but drops to a low in the vicinity of azimuth angle 250° in the case indicated by the double dot and dash line, arranging the antenna such that an obstruction lies in the direction of azimuth angle 250° will mitigate the influence of the obstruction and obtain a more effective antenna. As can be understood from FIG. 18, a radiation pattern with stronger directivity can be obtained by increasing the number of linear parasitic elements and enlarging the arc.

[Fifth Embodiment]

The frequency band over which transmission and reception are possible in a dipole antenna has a certain amount of breadth, and transmission and reception can be realized using a plurality of frequencies within this frequency band. An embodiment is next described that uses such a plurality of frequencies.

Figure 19A:
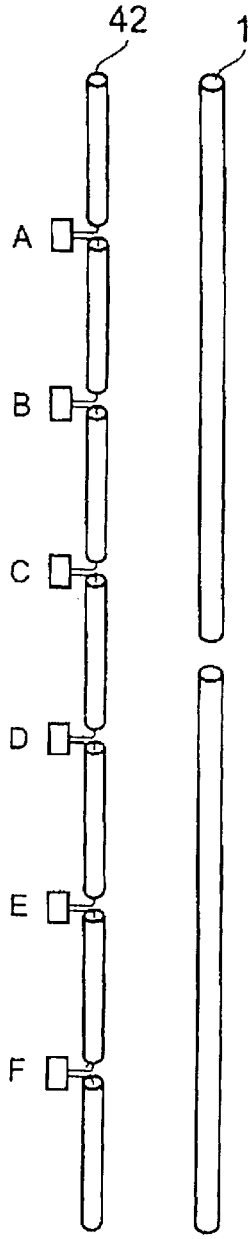
FIG. 19*a* is a schematic view showing the construction of the dipole antenna that is the fifth embodiment of the linear antenna of the present invention.
Figure 19B:
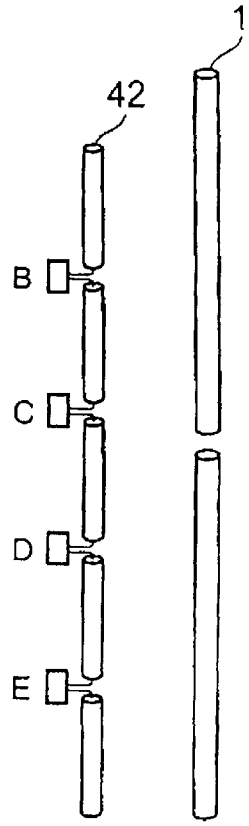
FIG. 19*b* is a schematic view showing one form of use of the dipole antenna shown in FIG. 19*a*.
Figure 19C:
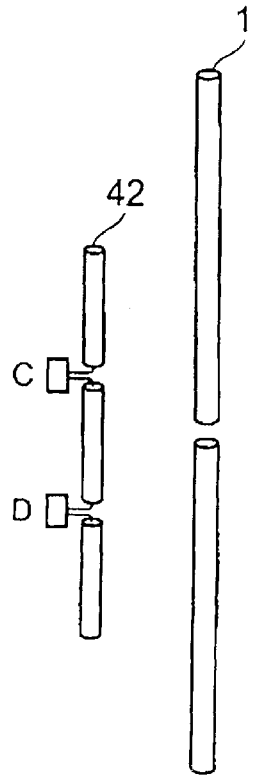
FIG. 19*c* is a schematic view showing one form of use of the dipole antenna shown in FIG. 19*a*.

FIGS. 19*a*–19*c* give schematic representations of the dipole antenna that is the fifth embodiment of the linear antenna of this invention. This dipole antenna is provided with linear parasitic elements 42 that are parallel and at a prescribed distance from common dipole 1, each of linear parasitic elements 42 being constructed such that seven cylindrical conductors of a prescribed length can be electrically connected via switches A–F (refer to FIG. 19*a*). In the example shown in FIGS. 19*a*–19*c*, the U-shaped parasitic element has been omitted for the sake of simplifying the explanation.

As explained in each of the above-described embodiments, the adjustment of directivity of common dipole 1 can be realized by providing linear parasitic elements around the circumference of common dipole 1, but in such cases, the length of the linear parasitic elements must be made the length of λ/2 of the transmission frequency. Thus, in a case of dealing with a plurality of transmission frequencies, switching from one transmission frequency to another transmission frequency also necessitates switching the length of the linear parasitic elements to the length of λ/2 of the transmission frequency that is to be used next. In this embodiment, this switching of the element length of the linear parasitic elements is made possible by controlling switches A–F. The length of the elements can be varied by turning switches A–F ON and OFF to change the number of cylindrical conductors that are electrically connected via the switches.

The operation of switching transmission frequencies in the dipole antenna of this embodiment is next explained in more concrete terms.

In the dipole antenna of this embodiment, a plurality of transmission frequencies can be handled by varying the element length of linear parasitic elements 42 in accordance with the transmission frequency. In a case in which the transmission frequencies are the two frequencies f1 and f2 (f1<f2), for example, when transmitting by transmission frequency f1, the element length is made the length of λ/2 of transmission frequency f1 by turning ON switches B–E and turning OFF switches A and F as shown in FIG. 19*b*, and when transmitting by transmission frequency f2, the element length is made the length of λ/2 of transmission frequency f2 by turning ON switches C and D and turning OFF switches A, B, E, and F as shown in FIG. 19*c*. In this way, the adjustment of directivity can be adequately realized at either of transmission frequencies f1 and f2, and the desired radiation pattern can be obtained.

Although only one linear parasitic element was provided in the foregoing explanation, the invention is not limited to this form. According to the present invention, a plurality of linear parasitic elements may be provided, and the element length of each linear parasitic element can be adjusted. In addition, the number of switches and cylindrical conductors that make up the linear parasitic elements are open to various modifications according to design.

[Sixth Embodiment]

The above-described first to fifth embodiments adjusted directivity within the horizontal plane of the common dipole, but directivity may also be adjusted within the vertical plane and a radiated beam may be directed either above or below the horizontal direction within the vertical plane.

Figures 20A, 20B, 20C:
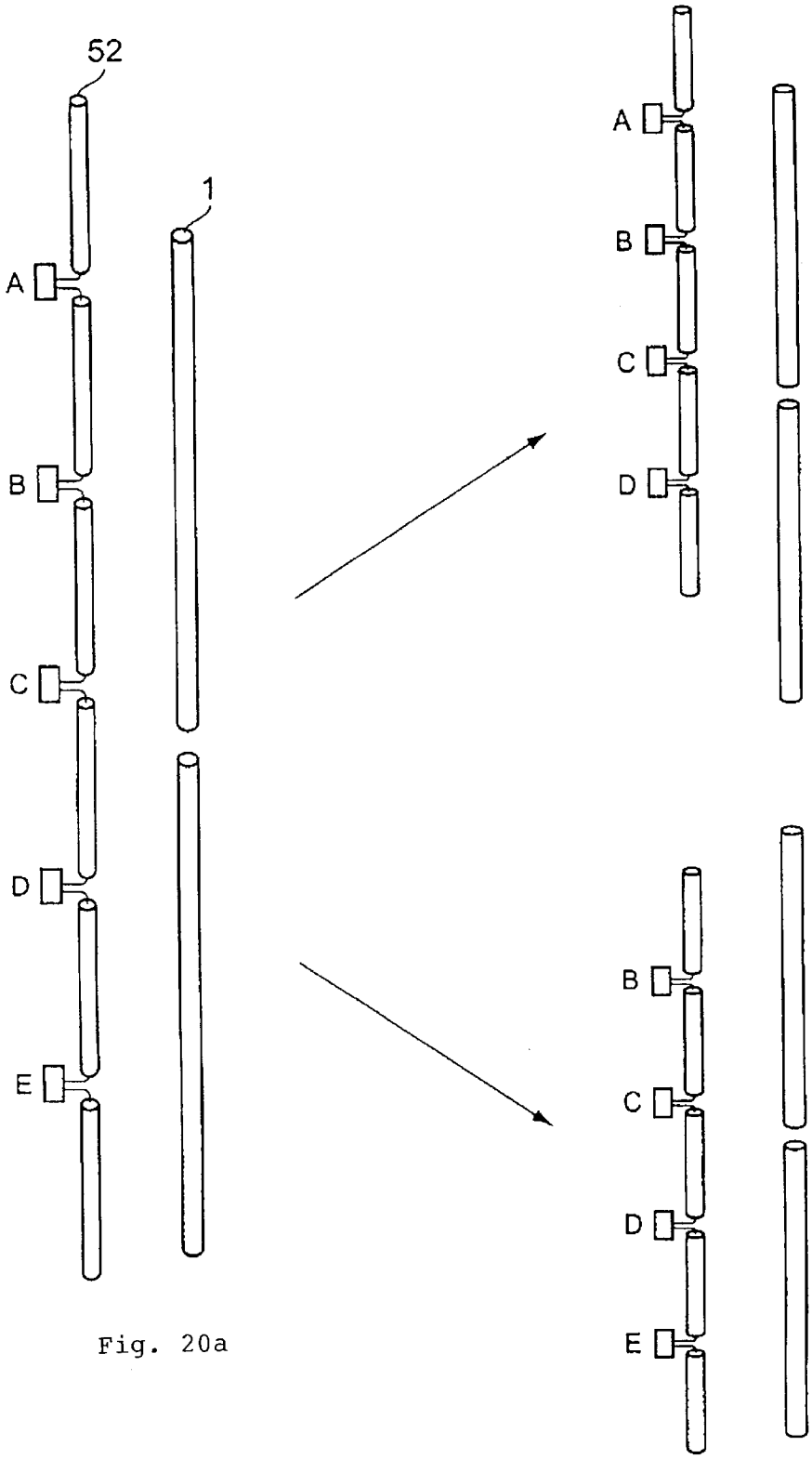
FIG. 20*a* is a schematic view showing the construction of a dipole antenna that is the sixth embodiment of the linear antenna of the present invention.
FIG. 20*b* is a schematic view showing one form of use of the dipole antenna shown in FIG. 20*a*.
FIG. 20*c* is a schematic view showing one form of use of the dipole antenna shown in FIG. 20*a*.

FIGS. 20*a*–20*c* show schematic views of a used form of a dipole antenna that is the sixth embodiment of the linear antenna of the present invention. In this dipole antenna, linear parasitic element 52, which is constructed such that six cylindrical conductors of a prescribed length can be electrically connected via switches A–E, is provided parallel to and separated by a prescribed distance from common dipole 1 (refer to FIG. 20*a*). Linear parasitic element 52 is constructed such that when switches A–D or switches B–E are ON, the length of the cylindrical conductors that are connected by these switches is the length of λ/2 of the transmission frequency. In the example shown in FIGS. 20*a*–20*c*, the U-shaped parasitic element has been omitted for the sake of simplifying the explanation.

In a case in which a radiated beam is to be directed below the horizontal direction within the vertical plane, switches A–D are turned ON and switch E is turned OFF as shown in FIG. 20*b*. The linear parasitic element having a length of λ/2 of the transmission frequency is thus shifted up with respect to common dipole 1, thereby directing a radiated beam below the horizontal direction within the vertical plane. The length of the cylindrical conductor that is cut off by switch E greatly diverges from the length of λ/2 of the transmission frequency, and this cylindrical conductor therefore does not affect the radiation characteristics of common dipole 1.

When directing a radiated beam above the horizontal direction within a vertical plane, switches B–E are turned ON and switch A is turned OFF, as shown in FIG. 20*c*. The linear parasitic element having a length of λ/2 of the transmission frequency is thus shifted down with respect to common dipole 1, whereby the radiated beam is directed above the horizontal direction within the vertical plane. Since the length of the cylindrical conductor that is cut off by switch A greatly diverges from the length of λ/2 of the transmission frequency, this cylindrical conductor exerts no influence on the radiation characteristics of common dipole 1.

According to the antenna of this embodiment, there is no need to mechanically move the antenna angle of the common dipole, and the angle of the radiated beam can be adjusted by merely switching switches. In a case in which the antenna of this embodiment is applied to, for example, cellular phones, interzone interference can be reduced by directing the radiated beam either above or below the horizontal direction within a vertical plane.

Although only one linear parasitic element was provided in the foregoing explanation, the invention is not limited to this form. A plurality of linear parasitic elements may be provided, and the element length of each linear parasitic element may also be adjusted. In addition, the number of switches and cylindrical conductors that constitute a linear parasitic element may also be variously modified according to design.

In each of the above-described embodiments, the U-shaped parasitic element that is provided for realizing impedance matching with the common dipole is not limited to the form shown in the figures, and an element of any form may be used as long as impedance matching is realized.

In addition, in the above-described third to sixth embodiments, the switches may be manually operated or may be operated by automatic control.

A linear antenna of the present invention that is constructed according to the foregoing explanation can adjust directivity more effectively than an antenna of the prior art because the linear parasitic elements are of the length of one half-wavelength of the transmission frequency, and moreover, can provide superior antenna performance than an antenna of the prior art because impedance matching can be realized by the U-shaped parasitic element.

Furthermore, since the length of the linear parasitic elements can be varied in the linear antenna of the present invention, the length of the linear parasitic elements can be set in accordance with a plurality of transmission frequencies. As a result, the invention provides an antenna that can be applied to a plurality of transmission frequencies, this versatility being beyond the capability of a construction of the prior art.

Still further, the linear antenna of the present invention allows the radiation pattern to be freely cast for all bearings or some of the bearings of the antenna by freely setting, of the linear parasitic elements that are arranged around a radiation element, those linear parasitic elements that contribute to the adjustment of directivity. In addition, a radiated beam can be directed either above or below the horizontal direction within the vertical plane by shifting the positional relation between the linear parasitic elements and the linear radiation element with respect to the longitudinal direction of the linear radiation element. As a result, a radiated beam can be cast in a direction within the horizontal plane or in a direction within the vertical plane without a mechanical construction, and the structure of the antenna therefore can be made more compact than an antenna of the prior art in which deflection of a radiated beam is realized by mechanical means.

In addition, the present invention can be easily applied to dipole antennas that are already on the market because the linear antenna of the present invention is a construction in which linear parasitic elements and a U-shaped parasitic element are arranged around a radiation element.

While preferred embodiments of the present invention have been described using specific terms, such description is for illustrative purposes only, and it is to be understood that changes and variations may be made without departing from the spirit or scope of the following claims.

What is claimed is:

1. A linear antenna comprising:

a linear radiation element;

at least one linear parasitic element having a length of one half-wavelength of a desired transmission frequency and arranged parallel to said linear radiation element; and a U-shaped parasitic element that is physically separated from said linear parasitic element and arranged in proximity to one end of said linear radiation element, wherein the U-shaped parasitic element provides impedance matching between the linear radiation element and a feed system.

2. A linear antenna according to claim 1 wherein a plurality of said linear parasitic elements are arranged in an arc so as to surround said linear radiation element.

3. A linear antenna according to claim 1 wherein said U-shaped parasitic element comprises two arms, these arms being arranged parallel to said linear radiation element.

4. A linear antenna according to claim 1 wherein said linear parasitic element and said U-shaped parasitic element are each printed on a plate composed of a dielectric material.

5. A linear antenna comprising:

a linear radiation element;

at least one linear parasitic element having a length of one half-wavelength of a desired transmission frequency and arranged parallel to said linear radiation element; and a U-shaped parasitic element that is arranged in proximity to one end of said linear radiation element, wherein said linear parasitic element is constructed of a plurality of linear conductors connected via switch elements wherein electrical connection may be effected between any adjacent linear conductors.

6. A linear antenna according to claim 5 wherein a length of linear conductors in said linear parasitic element that are electrically connected by all switch elements is the length of one half-wavelength of a desired transmission frequency.

7. A linear antenna according to claim 6 wherein a plurality of said linear parasitic elements are arranged in an arc so as to surround said linear radiation element.

8. A linear antenna according to claim 6 wherein a plurality of said linear parasitic elements are arranged so as to surround the entire circumference of said linear radiation element.

9. A linear antenna according to claim 5 wherein the length of linear conductors in said linear parasitic element that are electrically connected by a portion of switch elements is the length of one half-wavelength of a desired transmission frequency.

10. A linear antenna according to claim 9 wherein a plurality of said linear parasitic elements are arranged in an arc so as to surround said linear radiation element.

11. A linear antenna according to claim 9 wherein a plurality of said linear parasitic elements are arranged so as to surround the entire circumference of said linear radiation element.

12. A linear antenna according to claim 5 wherein a plurality of said linear parasitic elements are arranged in an arc so as to surround said linear radiation element.

13. A linear antenna according to claim 5 wherein a plurality of said linear parasitic elements are arranged so as to surround the entire circumference of said linear radiation element.

* * * * *